US010889112B2

(12) United States Patent
Kubo et al.

(10) Patent No.: US 10,889,112 B2
(45) Date of Patent: Jan. 12, 2021

(54) LIQUID EJECTION HEAD AND MANUFACTURING METHOD THEREOF

(71) Applicant: CANON KABUSHIKI KAISHA, Tokyo (JP)

(72) Inventors: Kousuke Kubo, Kawasaki (JP); Koichi Omata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/268,950

(22) Filed: Feb. 6, 2019

(65) Prior Publication Data

US 2019/0255849 A1 Aug. 22, 2019

(30) Foreign Application Priority Data

Feb. 19, 2018 (JP) ..... 2018-026778

(51) Int. Cl.
*B41J 2/14* (2006.01)

(52) U.S. Cl.
CPC ..... *B41J 2/14072* (2013.01); *B41J 2/14088* (2013.01); *B41J 2/14112* (2013.01); *B41J 2/14129* (2013.01); *B41J 2202/20* (2013.01); *B41J 2202/21* (2013.01)

(58) Field of Classification Search
CPC ..... B41J 2/14088; B41J 2/14112; B41J 2/14129; B41J 2/14072; B41J 2202/21
See application file for complete search history.

(56) References Cited

U.S. PATENT DOCUMENTS

| | | | | |
|---|---|---|---|---|
| 5,826,333 | A | 10/1998 | Iketani et al. | |
| 6,168,254 | B1 | 1/2001 | Karita et al. | |
| 6,331,051 | B1 | 12/2001 | Tajima et al. | |
| 7,267,430 | B2 | 9/2007 | Parish | |
| 7,896,475 | B2 | 3/2011 | Omata et al. | |
| 2012/0162317 | A1* | 6/2012 | Hirayama | B41J 2/04506 347/50 |
| 2014/0184703 | A1* | 7/2014 | Hatsui | B41J 2/14129 347/62 |
| 2015/0070438 | A1* | 3/2015 | Yabe | B41J 2/14129 347/50 |

* cited by examiner

*Primary Examiner* — Matthew Luu
*Assistant Examiner* — Kendrick X Liu
(74) *Attorney, Agent, or Firm* — Venable LLP

(57) ABSTRACT

The liquid ejection head includes a plurality of element substrates including first and second element substrates and an electrical wiring substrate. The first and second element substrates each has a heating element array in which a plurality of heating elements producing heat energy for liquid ejection is arrayed, an electrically conductive protection layer covering the plurality of heating elements, an insulating layer arranged between the plurality of heating elements and the electrically conductive protection layer, and a connecting terminal for connecting to the outside. The electrical wiring substrate is electrically connected with the first and second element substrates via the connecting terminal. On the first and second element substrates, the connecting terminal includes a connecting terminal for the electrically conductive protection layer, and the electrically conductive protection layer is electrically connected to a common wiring provided on the electrical wiring substrate via the connecting terminal.

13 Claims, 11 Drawing Sheets

LIQUID EJECTION HEAD AND MANUFACTURING METHOD THEREOF

BACKGROUND OF THE INVENTION

Field of the Invention

The present invention relates to a liquid ejection head and a manufacturing method thereof.

DESCRIPTION OF THE RELATED ART

Conventionally, there is a liquid ejection head comprising an element substrate including in order a substrate, a plurality of heating elements producing heat energy for liquid ejection by energization, an insulating layer for securing insulation properties with liquid of the heating element, and an electrically conductive protection layer that protects the heating element from thermal, physical, and chemical impacts. In the manufacturing process of the element substrate such as this, in the printing operation of the liquid ejection head, and so on, there is a case where dielectric breakdown occurs in the insulating layer of the element substrate resulting from electrostatic discharge (hereinafter, also identified as ESD).

The specification of U.S. Pat. No. 7,267,430 has described a configuration in which an electrically conductive protection layer is connected to a grounded-gate MOS (Metal-Oxide-Semiconductor) in order to prevent this phenomenon.

SUMMARY OF THE INVENTION

However, in a case where the grounded-gate MOS described in the specification of U.S. Pat. No. 7,267,430 is arranged as an ESD protection element for protecting the insulating layer from the ESD, an area about 100 μm square is necessary. Because of this, depending on the layout of a plurality of heating elements, it becomes difficult to secure a space for arranging the MOS within the element substrate. In particular, in a so-called line print head having a length corresponding to a width of a printing medium by a plurality of element substrates being connected, it is not possible to adopt the configuration in which the MOS is arranged on the end portion in the array direction of the heating element array because of the measures against black streaks or white spots of a printed image corresponding to the connecting portion of adjacent element substrates.

The present invention reduces a possibility that dielectric breakdown occurs in an insulating layer of an element substrate by an electrostatic discharge (ESD) current in a liquid ejection head including an element substrate (particularly, a plurality of element substrates) including a heating element producing heat energy for liquid ejection by energization.

In a first aspect of the present invention, there is provided a liquid ejection head comprising:

a plurality of element substrates including a first element substrate and a second element substrate, each of the first element substrate and the second element substrate having a heating element array in which a plurality of heating elements producing heat energy for liquid ejection by energization is arrayed, an electrically conductive protection layer covering the plurality of heating elements, an insulating layer arranged between the plurality of heating elements and the electrically conductive protection layer, and a connecting terminal for connecting to the outside; and an electrical wiring substrate electrically connected with the first element substrate and the second element substrate via the connecting terminal, wherein in each of the first element substrate and the second element substrate, the electrically conductive protection layer is electrically connected to a common wiring provided on the electrical wiring substrate via the connecting terminal.

In a second aspect of the present invention, there is provided a manufacturing method of a liquid ejection head, wherein the liquid ejection head includes:

a plurality of element substrates including a first element substrate and a second element substrate, each of the first element substrate and the second element substrate having a heating element array in which a plurality of heating elements producing heat energy for liquid ejection by energization is arrayed, an electrically conductive protection layer covering the plurality of heating elements, an insulating layer arranged between the plurality of heating elements and the electrically conductive protection layer, and a connecting terminal for connecting to the outside; and an electrical wiring substrate electrically connected to the first element substrate and the second element substrate via the connecting terminal, the manufacturing method of the liquid ejection head comprising:

a step of providing a base material on which the heating element electrically connected with an electrical wiring, the insulating layer, the electrically conductive protection layer, and the connecting terminal are formed;

a step of making an electrical inspection of the electrically conductive protection layer; and a step of manufacturing the first element substrate and the second element substrate each including the base material after the electrical inspection is made and electrically connecting the electrically conductive protection layer of each of the first element substrate and the second element substrate to a common wiring provided on the electrical wiring substrate via the connecting terminal.

According to the present invention, it is possible to effectively disperse and attenuate an electrostatic discharge (ESD) current that flows in from the surface of an element substrate in a liquid ejection head comprising a heating element producing energy for liquid ejection by energization. Consequently, it is made possible to reduce a possibility that dielectric breakdown of an insulating layer due to an ESD current occurs without the need to provide a configuration, such as a protection element, within a printing element substrate.

Further features of the present invention will become apparent from the following description of exemplary embodiments with reference to the attached drawings.

DESCRIPTION OF THE EMBODIMENTS

First Embodiment

In the following, an example of an embodiment of the present invention is explained by using the drawings. A liquid ejection head of the present embodiment is a so-called line print head having a length corresponding to a width of a printing medium by a plurality of printing element substrates being connected. However, it is also possible to apply the present invention to a so-called serial print head that performs printing while performing a scan for a printing medium. As a serial print head, there is a configuration including each of a printing element substrate for black ink and a printing element substrate for color ink. Further, the print head may also be a short line head whose length is shorter than a width of a printing medium, in which several printing element substrates, on which an ejection port array arrayed with a plurality of ejection ports is formed, are arranged so that the ejection ports on those printing element substrates overlap in the direction of the ejection port array. It is also possible to apply the present invention to an aspect in which the short line head is caused to scan a printing medium. It is possible to widely apply the embodiment of the present invention to a general liquid ejection head that ejects liquid, not limited to a print head that performs printing by ejecting ink.

(Printing Apparatus)

Figure 5:
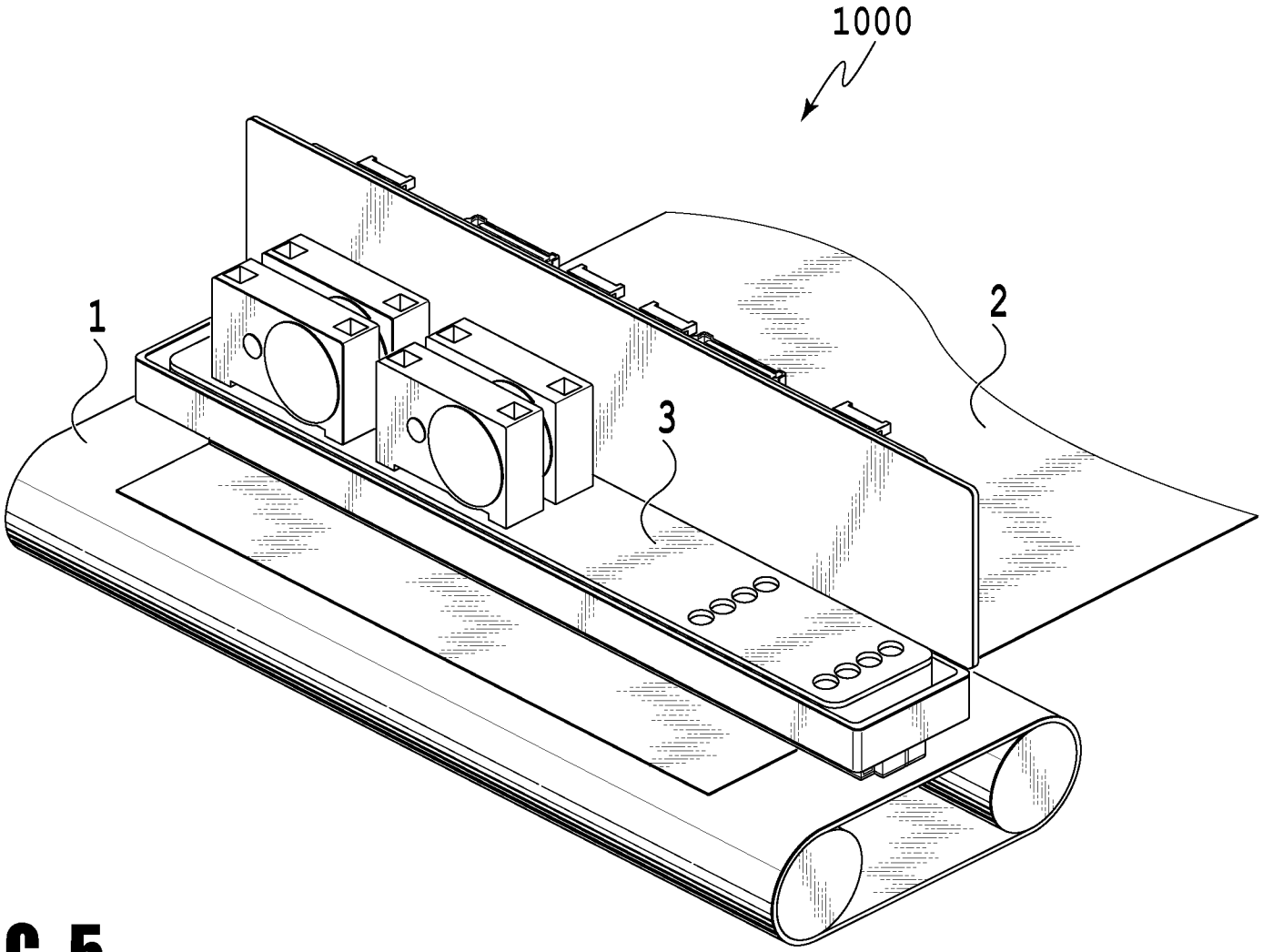
FIG. 5 is a perspective diagram of a liquid ejection apparatus in the first embodiment of the present invention.

FIG. 5 shows an outline configuration of an inkjet printing apparatus 1000 (hereinafter, also referred to as a printing apparatus) that performs printing by ejecting ink as a liquid ejection apparatus of the present embodiment. The printing apparatus 1000 is a line printing apparatus that comprises a conveying unit 1 configured to convey a printing medium 2 and a page-wide type line liquid ejection head 3 arranged approximately perpendicular to the conveying direction of the printing medium and performs one-pass printing continuously while conveying a plurality of printing media 2 continuously or intermittently. The printing medium 2 is not limited to a cut sheet, but may also be continuous roll paper. The printing apparatus 1000 comprises the liquid ejection head (print head) 3 capable of ejecting four kinds of ink, that is, CMYK (cyan, magenta, yellow, black). Further, to the liquid ejection head 3, an electric control unit configured to transmit power and an ejection control signal to the liquid ejection head 3 is connected electrically.

(Configuration of Liquid Ejection Head)

Figure 6A:
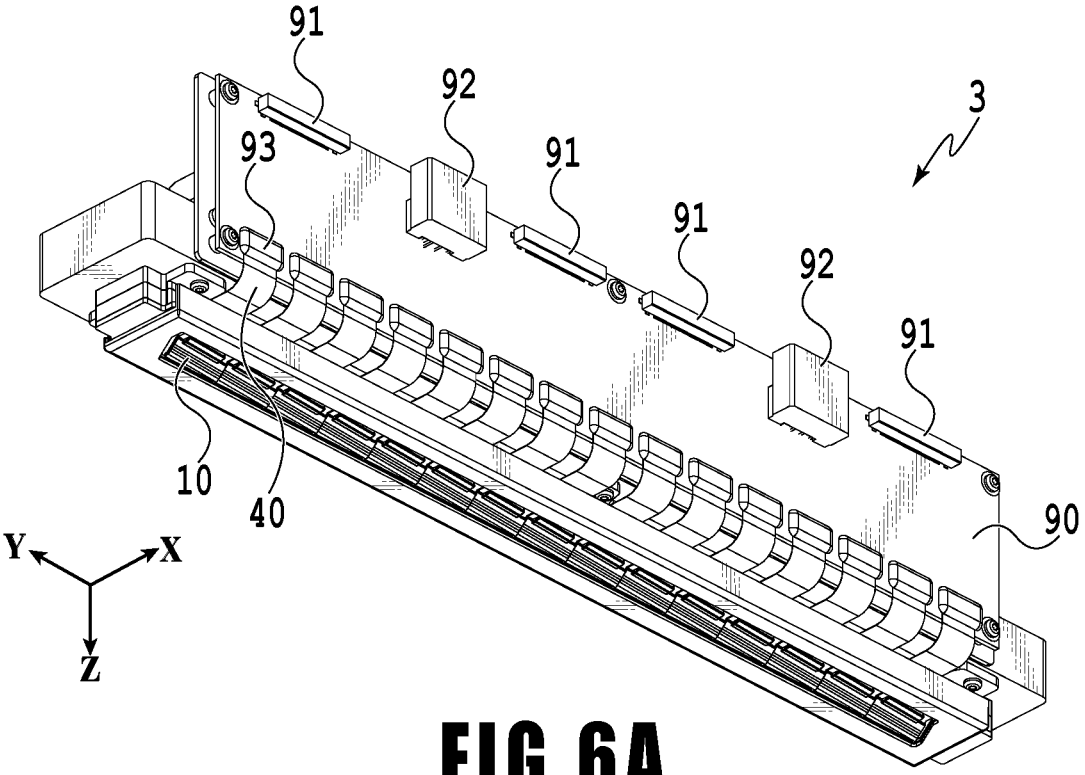
FIG. 6A and FIG. 6B are each a perspective diagram of a liquid ejection head in the first embodiment in a case of being viewed from different directions.
Figure 6B:
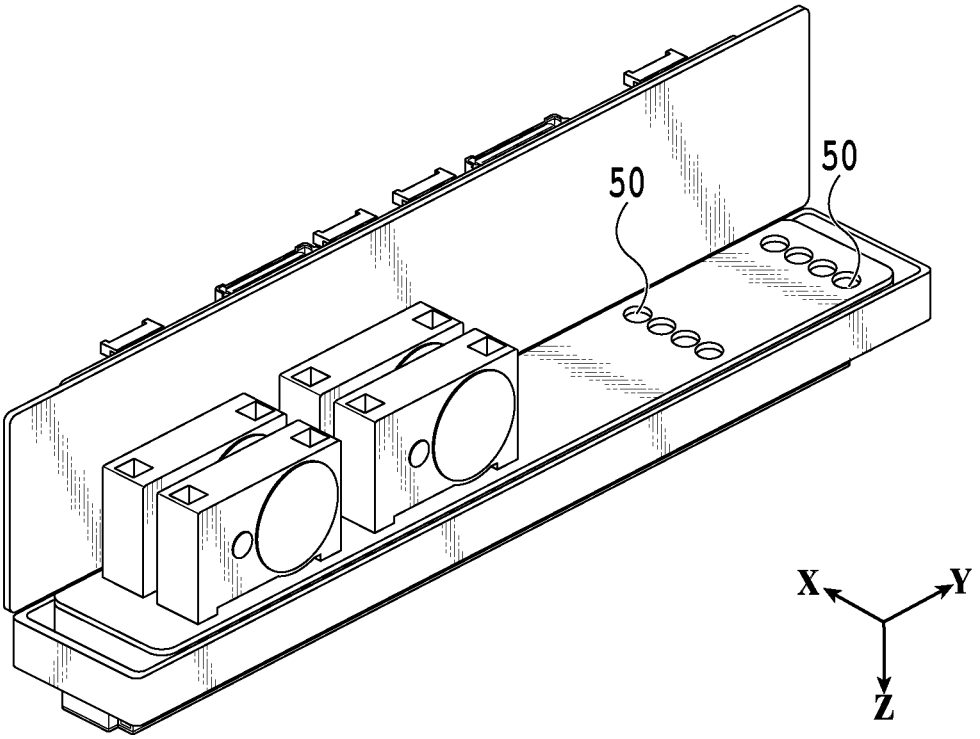

The configuration of the liquid ejection head 3 according to the first embodiment is explained. FIG. 6A and FIG. 6B are each a perspective diagram of the liquid ejection head 3 according to the present embodiment. The liquid ejection head 3 is a line liquid ejection head in which 15 printing element substrates (hereinafter, also referred to simply as element substrates) 10 capable of ejecting inks of four colors of CMYK by one printing element substrate are arrayed on a straight line (arranged in-line). As shown in FIG. 6A, the liquid ejection head 3 further comprises signal input terminals 91 and power supply terminals 92 electrically connected to those 15 element substrates 10 via individual flexible wiring substrates 40 corresponding to those 15 element substrates 10 and a common electrical wiring substrate 90. The signal input terminal 91 and the power supply terminal 92 are electrically connected with the control unit of the printing apparatus 1000 and supply an ejection drive signal and power necessary for ejection to the element substrate 10, respectively. It is possible to reduce the number of signal input terminals 91 and the number of power supply terminals 92 compared to the number of element substrates 10 by concentrating the wirings by an electric circuit within the electrical wiring substrate 90. Due to this, at the time of assembling the liquid ejection head 3 to the printing apparatus 1000, or at the time of exchange of the liquid ejection head 3, the number of electrical connecting portions that need to be removed may be small. As shown in FIG. 6B, liquid connecting portions 50 provided in the liquid ejection head 3 are connected with a liquid supply system of the printing apparatus 1000. Due to this, the four color inks of CMYK are supplied to the liquid ejection head 3 from the supply system of the printing apparatus 1000 and the inks having passed through the inside of the liquid ejection head 3 are collected to the supply system of the printing apparatus 1000. As described above, it is possible for each color ink to circulate via the path of the printing apparatus 1000 and the path of the liquid ejection head 3.

(Ejection Module)

Figure 7A:
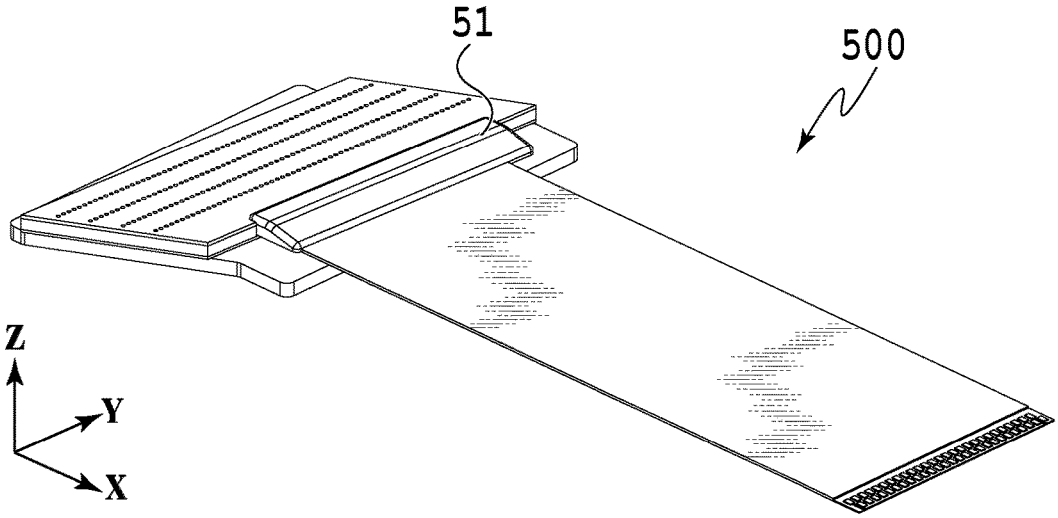
FIG. 7A is a perspective diagram of an ejection module in the first embodiment of the present invention and FIG. 7B is an exploded perspective diagram of the ejection module.
Figure 7B:
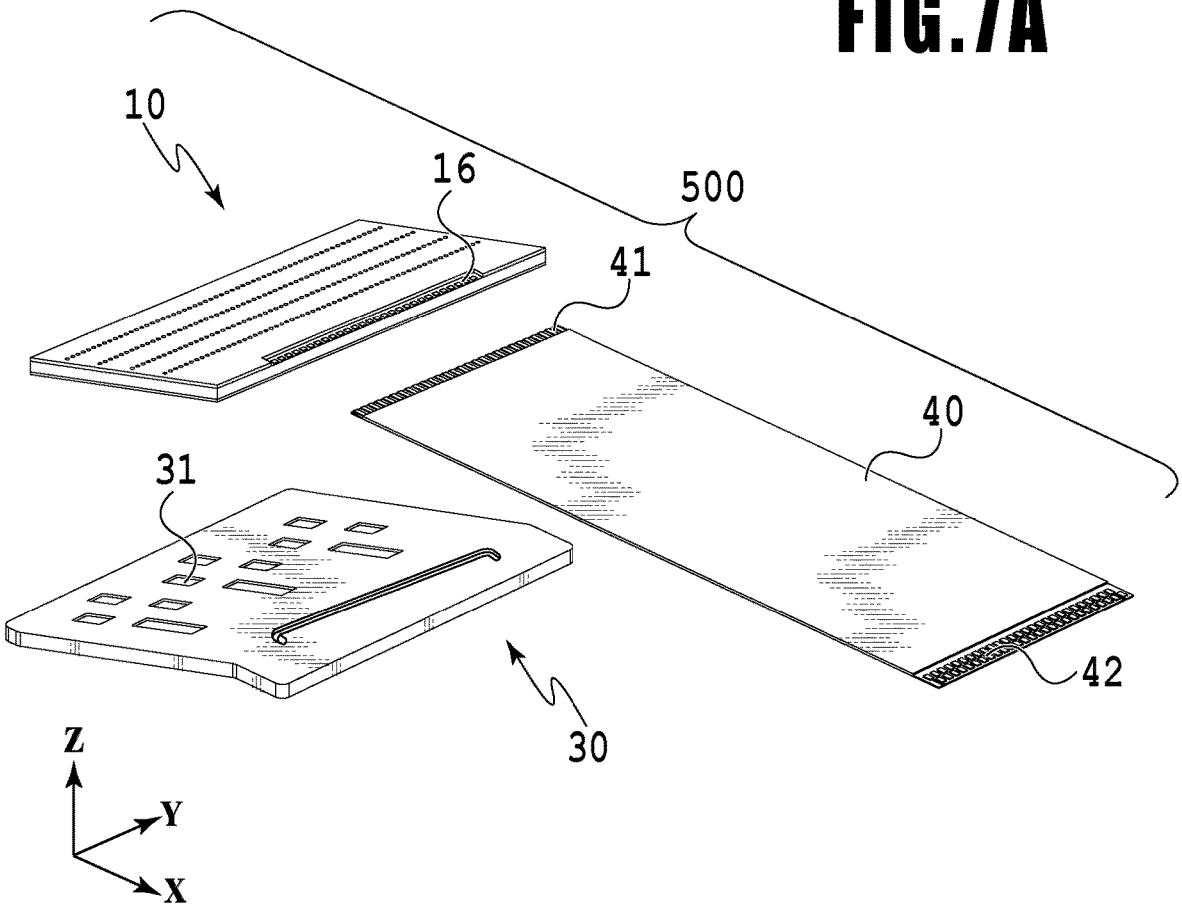

FIG. 7A is a perspective diagram of one ejection module 500 and FIG. 7B is an exploded perspective diagram of the ejection module 500. In a manufacturing method of the ejection module 500, first, the element substrate 10 and the flexible wiring substrate 40 are bonded onto a supporting member 30 provided in advance with a liquid communication port 31. After that, external connecting terminals 16 on the element substrate 10 and terminals 41 on the flexible wiring substrate 40 are electrically connected by wire bonding and then a sealed portion 51 is formed by coating the wire bonding portion (electrical connecting portion) by a sealing material. Terminals 42 that are terminals on the flexible wiring substrate 40 and which are separated from the element substrate 10 are in charge of the electrical connection with a connecting terminal 93 (see FIG. 6A) of the electrical wiring substrate 90. The supporting member 30 is a flow path member for causing the element substrate 10 and the flow path member (not shown schematically) to fluidly communicate with each other as well as a supporting body for supporting the element substrate 10, and therefore, it is preferable for the supporting member 30 to be one whose degree of flatness is high and to be capable of being joined with the element substrate with sufficiently high reliability. As the material of the supporting member 30, for example, alumina or a resin material is preferable.

(Structure of Element Substrate)

Figure 8A:
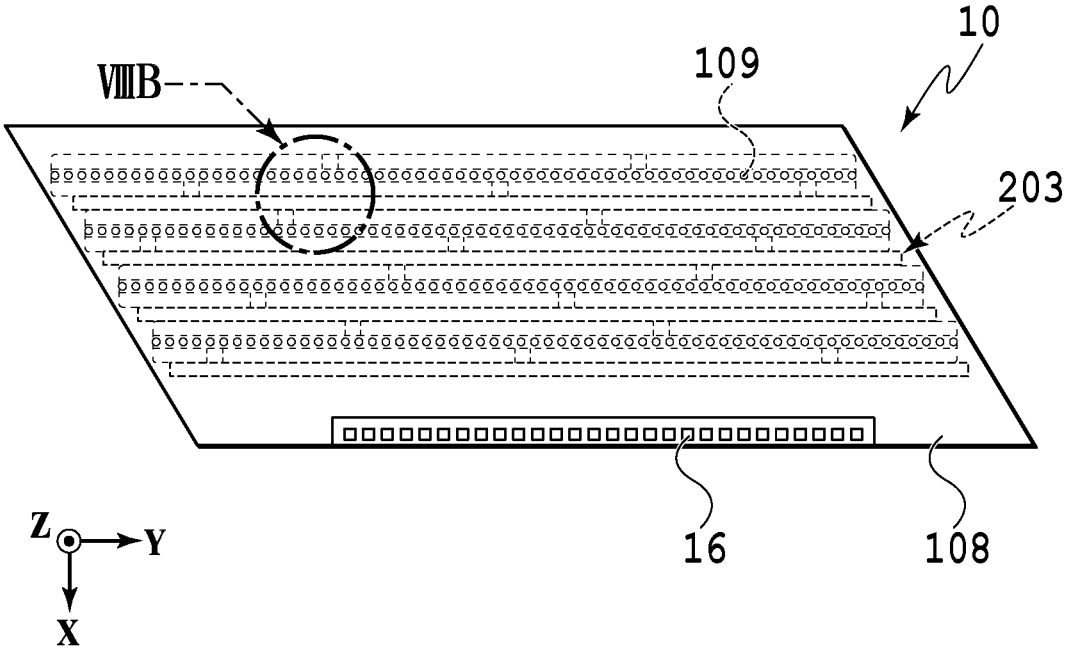
FIG. 8A is a plan diagram of a printing element substrate in the first embodiment of the present invention and FIG. 8B is an enlarged diagram of a VIIIB circle portion in FIG. 8A.
Figure 8B:
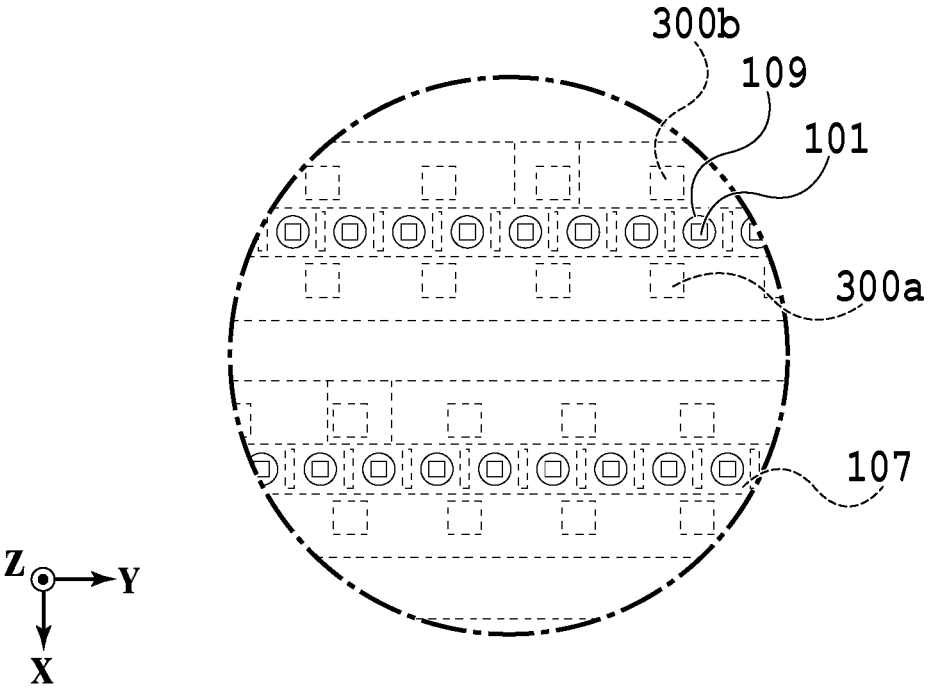
Figure 9A:
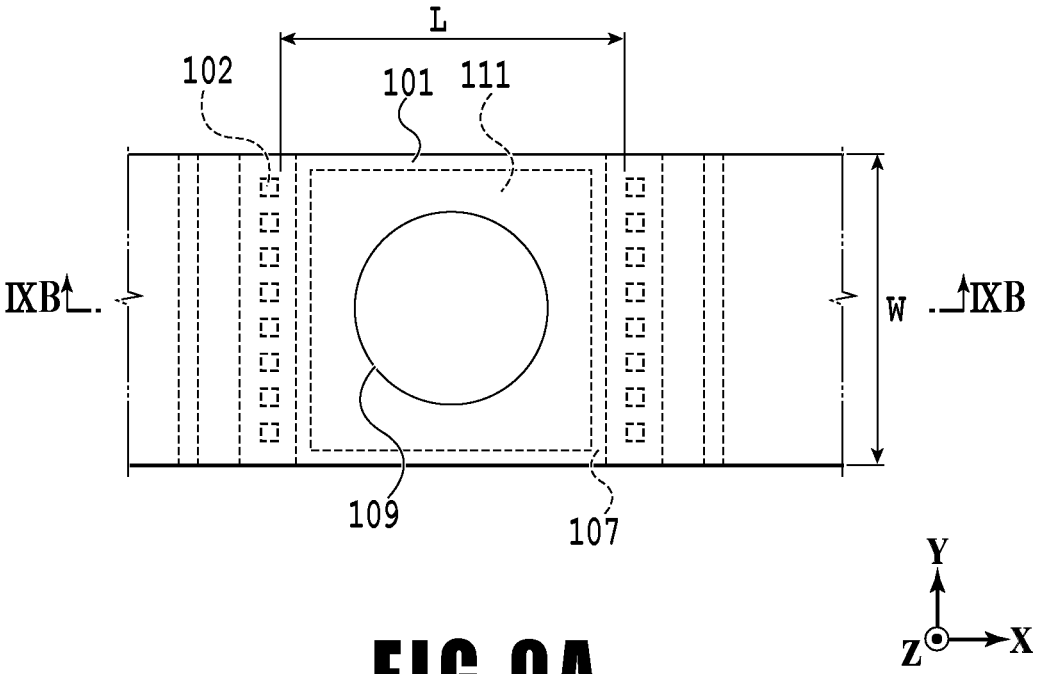
FIG. 9A is an enlarged diagram of an area around a heating element in FIG. 8B
Figure 9B:
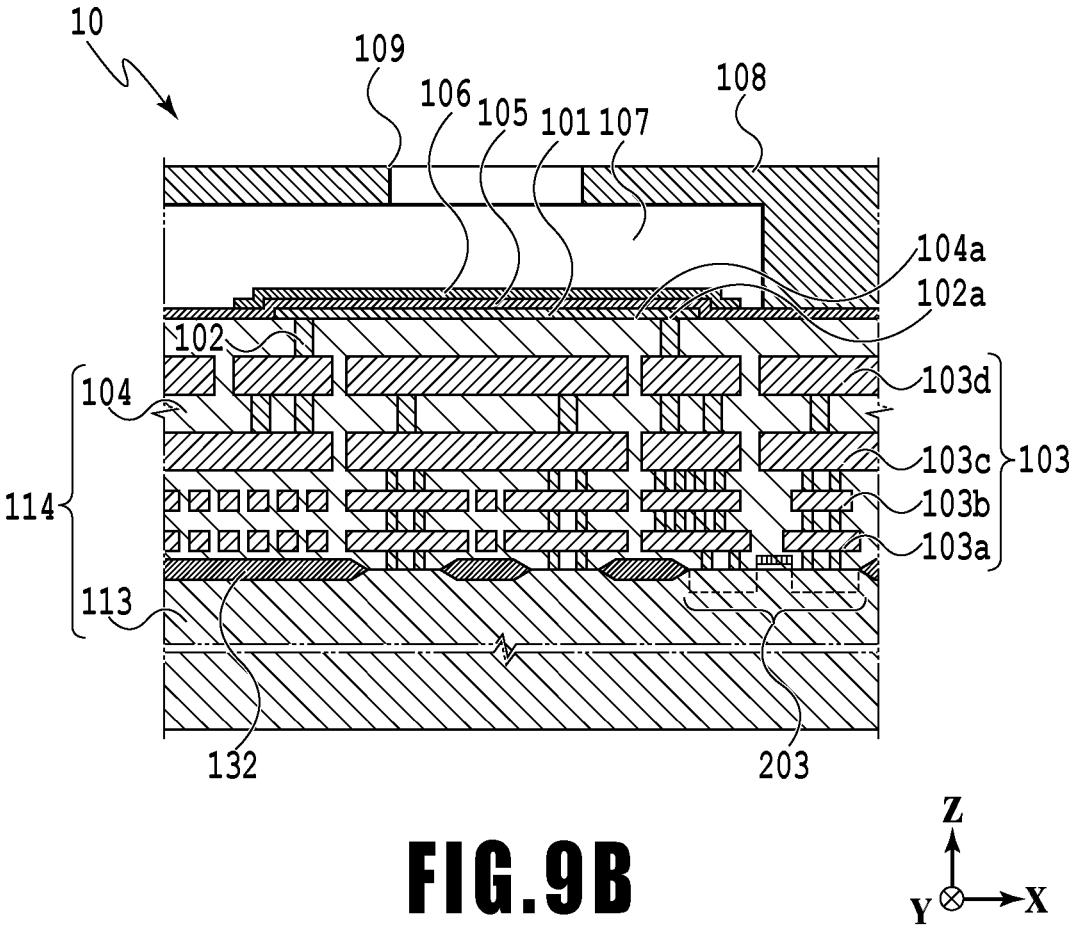
FIG. 9B is a sectional diagram along an IXB-IXB line in FIG. 9A.

By using FIG. 8A, FIG. 8B, FIG. 9A, and FIG. 9B, the structure of the element substrate 10 of the liquid ejection head 3 according to the first embodiment is explained. FIG. 8A is a plan diagram of the element substrate 10 of the present embodiment and FIG. 8B is an enlarged diagram of a VIIIB circle portion in FIG. 8A. FIG. 9A is an enlarged plan diagram of the vicinity of one heating resistor element 101 in FIG. 8B and FIG. 9B is a sectional diagram along an IXB-IXB line in FIG. 9A. In the following explanation, the direction in which a current flows through the heating resistor element is taken to be the X-direction. Further, the direction perpendicular to the X-direction and along the array direction of the heating resistor element and the ejection port is taken to be Y-direction. Furthermore, the direction perpendicular to the X-direction and the Y-direction is taken to be the Z-direction. The Z-direction is the direction perpendicular to an ejection port forming surface and along the direction in which liquid is ejected.

As shown in FIG. 9B, the printing element substrate 10 has a substrate 114 and an ejection port forming member 108. The substrate 114 includes a base material 113 formed by Si and a heat accumulating layer 104 formed on the base material.

The heat accumulating layer 104 is formed by an insulating material, such as a thermal oxide film, a SiO film, and a SiN film, and accumulates part of Joule heat produced in the heating resistor element and has a function to maintain the thermal responsiveness of the liquid ejection heat 3 in a favorable state. The heat accumulating layer 104 contributes to raise the temperature of the heating resistor element to a predetermined temperature necessary for printing in a short time.

On the heat accumulating layer 104, the heating resistor element 101 that produces heat energy for ejecting liquid (ink) by energization is provided. The heating resistor element is a resistor provided with two or more electrodes and producing heat in accordance with a potential difference between the electrodes. In the following, in the present specification, the heating resistor element is also referred to simply as a heating element. The heating element 101 is formed by a Ta compound, such as TaSiN. The film thickness (dimension in the Z-direction) thereof is about 0.01 to 0.05 μm and far smaller than the film thickness of an electrical wiring 103, to be described later.

The heating element 101 is covered by an insulating layer 105. The insulating layer 105 is a layer that covers the heating element in order to protect the heating element by securing insulation properties with liquid (ink) and is formed by an insulating material, such as SiN. The insulating layer 105 may be formed by SiO or SiC. The film thickness of the insulating layer 105 is about 0.15 to 0.3 μm.

The insulating layer 105 is covered by an electrically conductive protection layer 106. The electrically conductive protection layer 106 is a layer for protecting the heating element from thermal, physical, and chemical impacts at the time of foaming or defoaming of liquid (ink) and is also referred to as an anti-cavitation layer. The electrically conductive protection layer (anti-cavitation layer) 106 is formed by, for example, Ta and the film thickness is about 0.2 to 0.3 The electrically conductive protection layer 106 may be formed by the platinum group, such as Ir and Ru, in addition to Ta, and may also be a laminated film in which a plurality of layers formed by these materials are laminated.

On the side of a surface 104*a* on which the heating element 101 of the substrate 114 is formed, the ejection port forming member 108 is provided. In the ejection port forming member 108, an ejection port 109 corresponding to each heating element 101 is formed and the ejection port forming member 108 forms a pressure chamber 107 for each ejection port 109 together with the substrate 114.

As shown in FIG. 8A and FIG. 8B, at the center portion of the element substrate 10, the plurality of heating elements 101 are arranged in the form of arrays extending in the lengthwise direction (Y-direction) and arrays consisting of a plurality of independent ink supply ports 300*a* and 300*b*, respectively, are arranged so as to sandwich the array of the heating elements 101 in between. The pressure chamber 107 communicates with the independent ink supply ports 300*a* and 300*b* and the ink supplied from the independent ink supply ports is introduced into the pressure chamber 107. In a case of circulating ink through the pressure chamber 107, it is sufficient to use one of the independent ink supply ports 300*a* and 300*b* as a collection port through which ink is collected.

As shown in FIG. 8A and FIG. 9B, the element substrate 10 is provided with a drive circuit 203 for driving the heating element 101. The drive circuit 203 is connected to the external connecting terminal 16 provided at the end portion in the short-side direction X of the substrate 114 and generates a drive current of the heating element 101 in accordance with a print signal supplied from the outside of the liquid ejection head via the external connecting terminal 16. Within the heat accumulating layer 104 provided in the substrate 114, the electrical wirings 103 are formed. The electrical wirings 103 (103*a*, 103*b*, 103*c*, 103*d*) are patterns, such as a signal wiring and a power source wiring, and includes the heating element drive wiring 103*c* that supplies power for the heating element 101 and the heating element drive ground wiring 103*d* that applies a ground potential to the heating element. The electrical wirings 103 are provided so as to be embedded in the heat accumulating layer 104. The electrical wirings 103 electrically connect the drive circuit 203 and the heating element 101 via a connecting member 102. The electrical wirings 103 are made of aluminum and the film thickness (dimension in Z-direction) thereof is about 0.6 to 1.2 μm. By the supplied current, the heating element 101 heats up and the heating element 101 having become high in temperature heats the ink within the pressure chamber 107 to produce air bubbles. By the air bubbles, the ink in the vicinity of the ejection port 109 is ejected from the ejection port 109 and printing is performed.

Within the heat accumulating layer 104, the plurality of connecting members 102 for connecting the electrical wiring 103 and the heating element 101 is provided. As shown in FIG. 9B, the connecting member 102 extends in the film thickness direction (Z-direction) and further, as shown in FIG. 9A, the plurality of connecting members 102 are arranged with an interval in between along the Y-direction. The connecting member 102 is covered by the heating element 101 in a case where the connecting member 102 is viewed from the direction (−Z-direction) perpendicular to the surface on which the heating element 101 is provided. The connecting member 102 is provided in the vicinity of both ends (one end side and the other end side) of the heating element 101 in the X-direction and connects the electrical wiring 103 and the heating element 101. Because of this, in the heating element 101, a current flows along the X-direction. In the present embodiment, the connecting members 102 are arranged approximately equally across an entire width W in the Y-direction of the heating element 101 as a plurality of members whose section is approximately square. The shape and arrangement of the connecting members 102 such as this are set from the viewpoint of approximate equalization of the way the current that flows along the X-direction flows in the heating element 101 on the entire surface of the heating element and the viewpoint of easiness of manufacturing. The connecting member 102 has a function as a plug that extends from the vicinity of the end portion of the electrical wiring 103 in the Z-direction. The connecting member 102 has an approximately square section in the present embodiment as described above, but the corner portion may be rounded and the connecting member 102 may have another shape, such as a rectangle, a circle, and an ellipse, not limited to a square. The connecting member 102 is formed by tungsten, but it is possible to form the connecting member 102 by one of titanium, platinum, cobalt, nickel, molybdenum, tantalum, and silicon, or a compound thereof. The connecting member 102 may be formed integrally with the electrical wiring 103. That is, it may also be possible to form the connecting member 102 integrated with the electrical wiring 103 by cutting away part of the electrical wiring 103 in the thickness direction.

As shown in FIG. 9B, the electrical wiring 103 is provided in the heat accumulating layer 104 and connected to the heating element 101 by the connecting member 102. As described above, electrical connection is made from the backside side (the base material 113 side) for the heating element 101, and therefore, in the present embodiment, the electrical wiring that covers the surface side (opposite side of the base material side) of the heating element 101 is no longer necessary. The film thickness of the heating element 101 is about 0.01 to 0.05 μm as described above and the step is significantly small compared to the conventional configuration in which the electrical wiring covers the surface side of the heating element. Consequently, it is possible to secure sufficient coverage properties by the insulating layer 105 having a film thickness of about 0.15 to 0.3 μm, and therefore, it is made possible to reduce the thickness of the insulating layer 105 and the heat transmission efficiency to ink improves significantly. Due to this, it is possible to cause both a reduction in power consumption and an increase in image quality due to stability of foaming to be consistent with each other. It is also possible to expect improvement of the patterning accuracy and the reliability of the electrically conductive protection layer 106, improvement of the adherence properties of the ejection port forming member 108 to the substrate 114 and the machining accuracy of the ejection port forming member 108, and so on. Therefore, it is possible to obtain not only the high image quality but also the merit in manufacturing.

The connecting positions of the connecting members 102 for the heating element 101 specify a real length (effective length L) in the X-direction of the heating element 101. The effective length L of the heating element 101 is equal to the interval between the connecting member 102 on one end side of the heating element 101 in the X-direction and the connecting member 102 on the other end side. By increasing the dimensional accuracy of the effective length L of the heating element 101, it is possible to increase the dimensional accuracy of the length in the X-direction of a foaming area 111, which is an area in which liquid foaming occurs. In general, the conventional liquid ejection head is formed by etching the electrical wiring 103 by wet etching into the shape of the heating element, and therefore, it is difficult to improve the dimensional accuracy of the effective length L of the heating element 101. In contrast to this, in the present embodiment, the connecting member 102 is formed by forming a hole in the flat heat accumulating layer 104 by dry etching and embedding the material of the connecting member 102 in the hole, and therefore, compared to the conventional configuration, the dimensional accuracy of the effective length L of the heating element 101 is relatively high. It is possible to form the heating element 101 by patterning the film of the thin heating element 101, and therefore, it is also possible to increase the dimensional accuracy of the width W in the Y-direction of the heating element 101.

By the improvement of the dimensional accuracy of the heating element 101, the variations of the foaming properties among the heating elements 101 are reduced. Due to this, in addition to that it is possible to implement a high image quality of the liquid ejection head, it is no longer necessary to input excessive energy in view of the variations of the foaming properties, and therefore, it is possible to implement a reduction in power consumption. Further, for the configuration in which the connecting member 102 is not embedded in a hole, that is, no plug is provided, and connection with the electrical wiring 103 is made directly from the hole, it is also possible to form a heating element whose reliability is high because the film of the heating element is formed on a flat background in the present invention.

In order to obtain more uniform ink ejection characteristics by suppressing the variations of the foaming properties and the variations of the resistance value, it is preferable for the background (lower area) of the heating element 101 to be flat. In the past, it was difficult to arrange a wiring pattern directly under and around the heating element without producing a step. In the present embodiment, the electrical wiring 103 of each layer and the background portion of the heating element 101 are flattened by the processing, such as CMP (chemical mechanical polishing). Due to this, as shown in FIG. 9B, a contact surface 102*a* in the connecting member 102, which comes into contact with the heating element 101, and the contact surface 104*a* in the heat accumulating layer 104, which comes into contact with the heating element 101, are formed in the same plane. As described above, by flattening the background (lower area) of the heating element 101, it is made possible to route a wiring pattern, such as the electrical wiring 103, through the area or the periphery of the heat accumulating layer 104 between the heating element 101 and the base material 113 located directly under the heating element 101. Further, it is also made possible to arrange a transistor in that area, and therefore, it is possible to reduce the area of the element substrate 10 and it is made possible to reduce the cost of the liquid ejection head 3 and to increase the density of the ejection ports 109. In the present embodiment, as shown in FIG. 9B, in the interface area with the heat accumulating layer 104 in the base material 113 formed by Si, the drive circuit 203 and a field oxide film 132 are formed. The field oxide film 132 has a function to separate adjacent elements and separates the base material 113 and the heat accumulating layer 104.

(Position Relationship Between Element Substrates)

Figure 10:
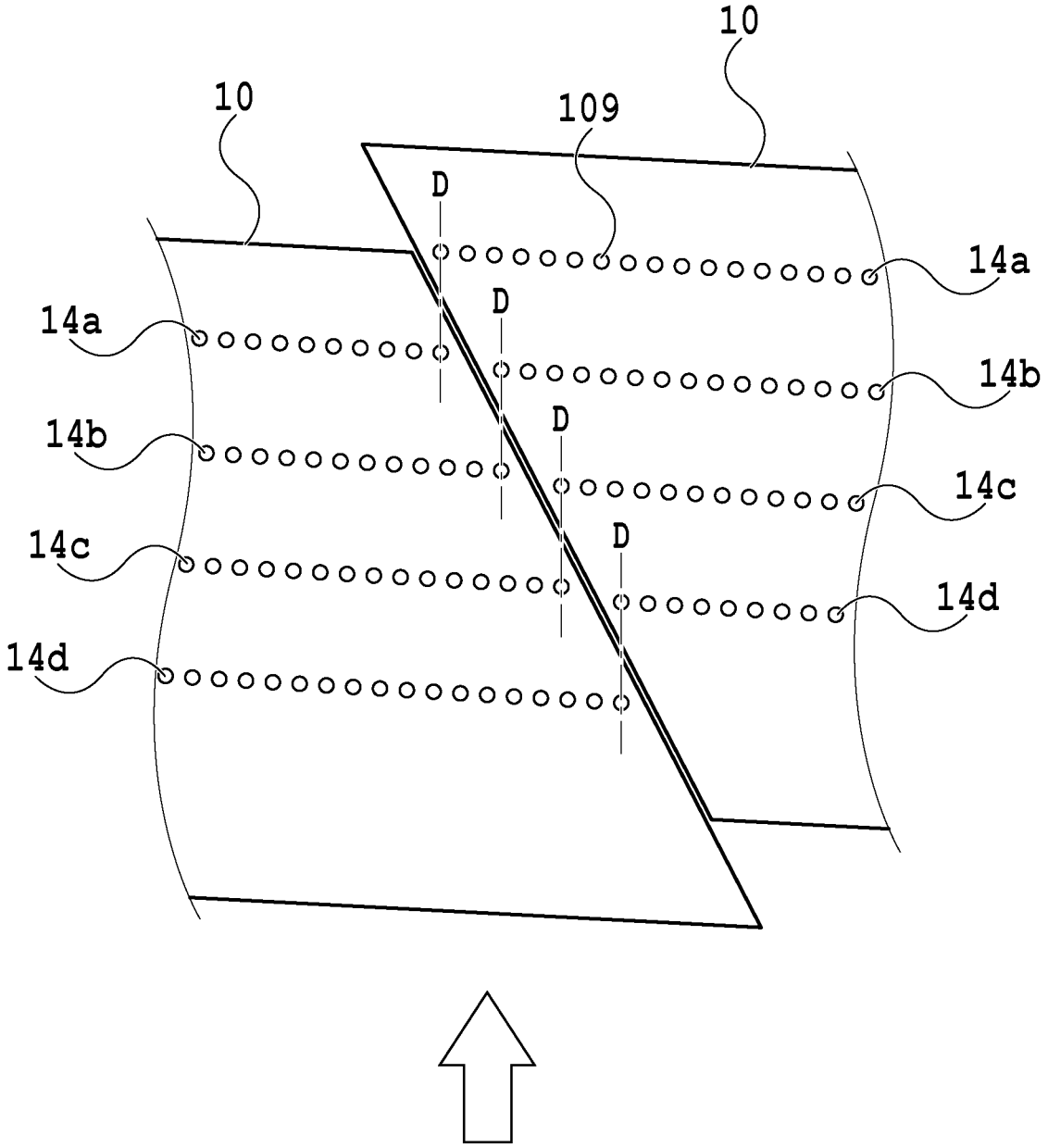
FIG. 10 is a plan schematic diagram showing a position relationship between adjacent element substrates.

FIG. 10 is plan diagram showing the adjacent portion of the element substrate in the two adjacent ejection modules by partially enlarging the portion. As shown in FIG. 8A, in the present embodiment, the element substrate whose shape is an approximate parallelogram is used. As shown in FIG. 10, each ejection port array 14 (14*a*, 14*b*, 14*c*, 14*d*) in which the ejection ports 109 are arrayed on each element substrate 10 is arranged to as to be inclined by a predetermined angle with respect to the conveyance direction of a printing medium, which is shown by an arrow in FIG. 10. Due to this, the ejection arrays at the adjacent portion between the element substrates 10 are in a position relationship in which at least one ejection port of the element substrate 10 and at least one ejection port of the other element substrate 10 overlap in the conveyance direction of the printing medium. In FIG. 10, the two ejection ports on a D line are in the position relationship in which the two ejection ports overlap. Due to the arrangement such as this, even in a case where the position of the element substrate 10 shifts somewhat from a predetermined position, it is possible to make less conspicuous the black streak and the white spot of a printed image by the drive control of the ejection ports that overlap. Also in a case where a plurality of element substrates 10 is arranged on a straight line (in-line) in place of staggered arrangement, by the configuration as shown in FIG. 10, it is possible to suppress an increase in the length (dimension) of the liquid ejection head 3 in the conveyance direction of the printing medium. Further, it is possible to make less conspicuous the black streak and the white spot of a printed image corresponding to the connecting portion between the element substrates 10. In the present embodiment, the main plane of the element substrate is a parallelogram, but the present invention is not limited to this and, for example, even in a case where a rectangular element substrate, a trapezoidal element substrate, or an element substrate in another shape is used, it is possible to preferably apply the configuration of the present invention.

Figure 1A:
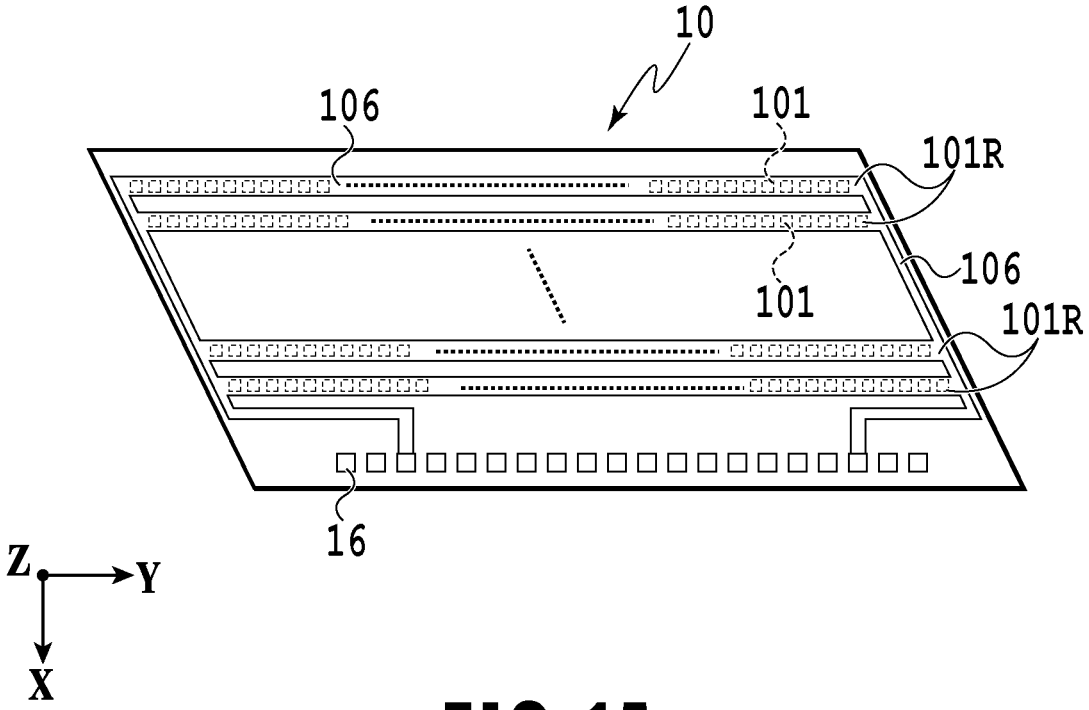
FIG. 1A is a plan schematic diagram of an element substrate in a first embodiment of the present invention and FIG. 1B is a wiring connection diagram on the element substrate.

FIG. 1A is a plan diagram of the element substrate 10 in the present embodiment. A plurality of heating element arrays (heating resistor element arrays) 101R including the plurality of heating elements 101 are arranged in accordance with the shape of the substrate. The plurality of external connecting terminals 16 for electrical connection with the outside of the element substrate are arranged along the long side of the element substrate 10. In order to secure the insulation properties with liquid of the heating element 101 arranged in the element substrate 10 and the like, the insulating layer 105 (FIG. 9B) is formed in the upper layer of the heating element in the element substrate. The electrically conductive protection layer 106 is provided in the upper layer of the insulating layer 105. The electrically conductive protection layer 106 includes a belt-shaped portion that covers the heating element array 101R and a connecting portion arranged at a position different from the position at which the heating element array 101R is covered. The latter connecting portion is a connecting portion that connects the external connecting terminal 16 and the belt-shaped portion for electrical connection between the electrically conductive protection layer and the external connecting terminal 16 for connecting the electrically conductive protection layer 106 with the outside. In the present embodiment, a plurality of belt-shaped portions covering each heating element array 101R are provided and the plurality of belt-shaped portions are connected to one another by the connecting portion. The connecting portion connects between a plurality of different portions of each belt-shaped portion (in this example, one end side and the other end side in the Y-direction (array direction)) and a plurality of different external connecting terminals 16 corresponding thereto, respectively. Due to this, the electrically conductive protection layer 106 forms a loop shape on the element substrate 10.

According to the configuration of the present embodiment, in a case where an ESD current flows in from the surface of the element substrate 10, it is possible to cause the ESD current to effectively escape to the outside of the element substrate by the ESD current flowing to the external connecting terminal from the electrically conductive protection layer 106. Further, in the present embodiment, the electrically conductive protection layer 106 is a loop in shape and the end portion of the connecting portion is connected to the different external connecting terminals 16. Because of this, even in a case where the ESD current flows in from the surface end portion of the element substrate 10, it is possible to cause the current to escape from the external connecting terminal 16 nearest to the portion at which the current has flowed in.

As described above, according to the present embodiment, without the need to provide a special configuration, such as an ESD protection element, on the element substrate, it is possible to cause an ESD current to escape to the external connecting terminal irrespective of the position at which the current has flowed in. In the present embodiment, the electrically conductive protection layer 106 is connected with the two external connecting terminals, but in the present invention, this is not limited and the electrically conductive protection layer 106 may be connected with one or a plurality (three or more) of external connecting terminals. In a case where the number of connection-target external connecting terminals is large, it is possible to cause an ESD current that flows in to escape quickly to the outside from the external connecting terminal in the vicinity of the portion at which the current has flowed in. Further, in a case where the number of connection-target external connecting terminals is small, it is possible to design a compact configuration.

It may also be possible to divide the plurality of belt-shaped portions forming the loop shape of the electrically conductive protection layer into groups in accordance with the arrangement of the heating element arrays and to connect a different external connecting terminal for each group. In this case also, from the viewpoint of causing an ESD current to escape quickly, it is desirable to have at least two external connecting terminals for each loop shape of the electrically conductive protection layer.

In a case where there is a defect, such as a pinhole, in the insulating layer 105 of the element substrate 10, the heating element 101 and the electrically conductive protection layer 106 are brought into conduction and an electrochemical reaction occurs between the electrically conductive protection layer 106 and liquid (ink), and therefore, there is a concern that the electrically conductive protection layer 106 changes in quality. In a case where the electrically conductive protection layer 106 changes in quality, the heat efficiency of energy transferred from the heating element 101 to liquid changes, and therefore, it is necessary to inspect the insulation properties between the heating element 101 and the electrically conductive protection layer 106 in the manufacturing stage of the element substrate 10. Because of this, an aspect is secured such that it is possible to inspect the insulation properties between the electrically conductive protection layer 106 and the heating element 101 by using the external connecting terminal 16 connected to the electrically conductive protection layer 106 by bringing the electrically conductive protection layer 106 into an electrical floating state (state where electric potential is independent) in the state of the element substrate (wafer). Also from the viewpoint of making the inspection of insulation properties, it is preferable for the configuration to be one in which the electrically conductive protection layer is connected with a plurality of external connecting terminals.

Figure 11:
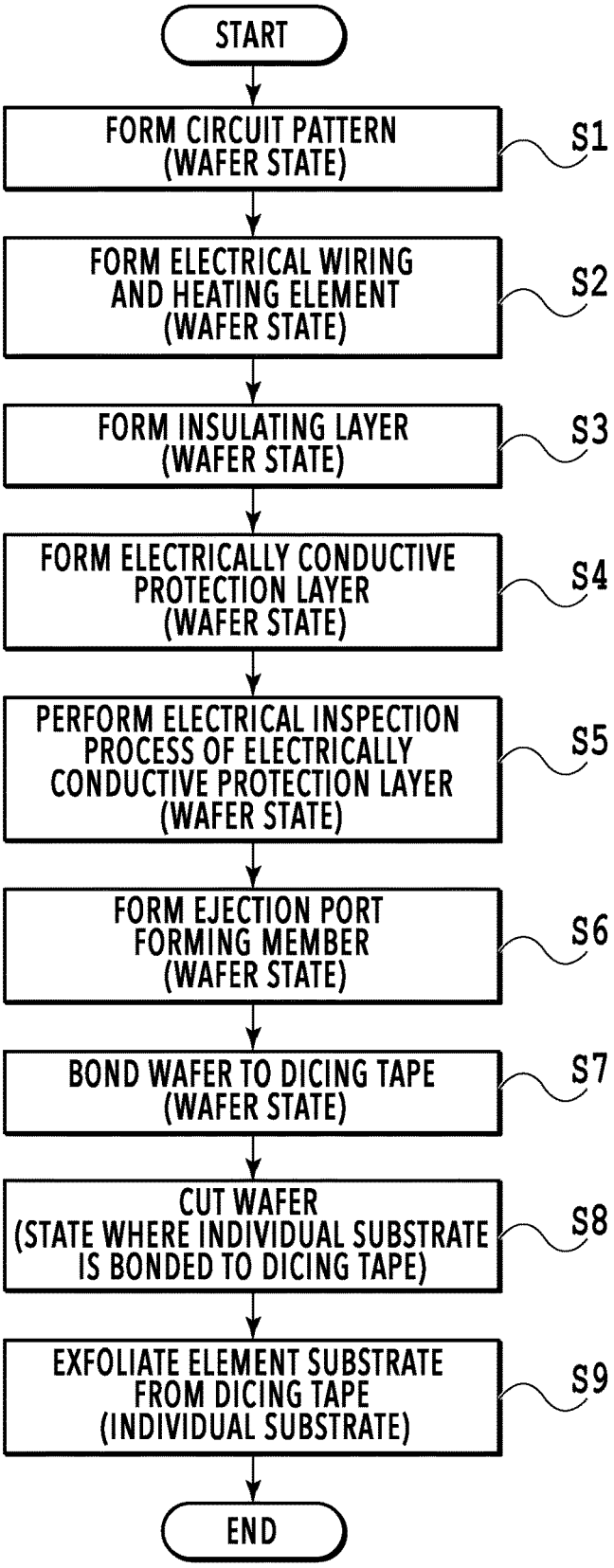
FIG. 11 is a flowchart for explaining a manufacturing process of an element substrate.

FIG. 11 is a flowchart of a manufacturing process of the element substrate in the embodiment of the present invention. Symbol "S" in the explanation of each block of processing means a step in the flowchart. S1 to S4 are processes to form a circuit pattern, such as the drive circuit 203, the electrical wiring 103 and the heating element 101, the insulating layer 105, and the electrically conductive protection layer 106, respectively, for the base material 113 in the wafer state.

Next, at S5, an electrical inspection is made for the electrically conductive protection layer 106. This electrical inspection process is performed before the base material 113 in the wafer state is cut. In the electrical inspection process, not only the check of the operation of various circuits and the check of the withstand voltage properties against voltage, but also, as described previously, the inspection of whether the insulation properties of the electrically conductive protection layer 106 coming into contact with liquid at the time of use, for the heating element 101 and the electrical wiring 103, are secured is made.

In order to inspect the insulation properties of the electrically conductive protection layer 106 for the heating element 101 and the electrical wiring 103, a state of liquid at the time of use in a case where the pressure chamber 107 is filled with the liquid is simulated. In the simulation, it is considered sufficient to set the potential of the electrically conductive protection layer 106 to the ground potential (reference potential (0 V)) and to apply a positive potential to the heating element drive wiring 103*c* and the heating element drive ground wiring 103*d*, both for supplying power to the heating element. However, it is not possible to apply a positive potential to the heating element drive ground wiring (hereinafter, also referred to simply as drive ground wiring) 103*d*. The reason is that in the drive ground wiring 103*d*, a protection element (protection circuit) for preventing breakdown by an ESD current is included and because of the withstand voltage performance of the protection element, it is not possible to apply a high potential to the drive ground wiring 103*d*. Because of this, in the present embodiment, the potential of the electrical wiring, such as the heating element drive wiring (hereinafter, also referred to simply as drive wiring) 103*c* and the drive ground wiring 103*d*, is set to the ground potential and a negative potential is applied to the electrically conductive protection layer 106. Due to this, it is possible to match the relative relationship of potential with that at the time of use, and therefore, it is possible to simulate the state at the time of use in a case where the pressure chamber 107 is filled with the liquid.

In the electrical inspection, a threshold value of a leak current is set for the voltage that is applied to the electrically conductive protection layer 106 and in a case where a flow of a current larger than the threshold value is detected, the product is determined to be a defective product and in a case where a flow of a current smaller than the threshold value is detected, the product is determined to be a conforming product.

At next S6, a dry film is bonded to the base material 113 and the ejection port forming member 108 is formed by using a resist coating and the like. At next S7, the base material 113 is bonded to a dicing tape. At next S8, the base material 113 is cut by laser dicing and the like. That is, by performing cutting along the peripheral edge portion of the element substrate, individual element substrates are cut out from a wafer.

After the cutting of the base material 113, at S9, the dicing tape is exfoliated from the element substrate. In this manner, the element substrate in the embodiment of the present invention is manufactured. The manufactured element substrate is incorporated in the ejection module and further, by the plurality of ejection modules being incorporated in the liquid ejection head, one liquid ejection head is manufactured.

Figure 1B:
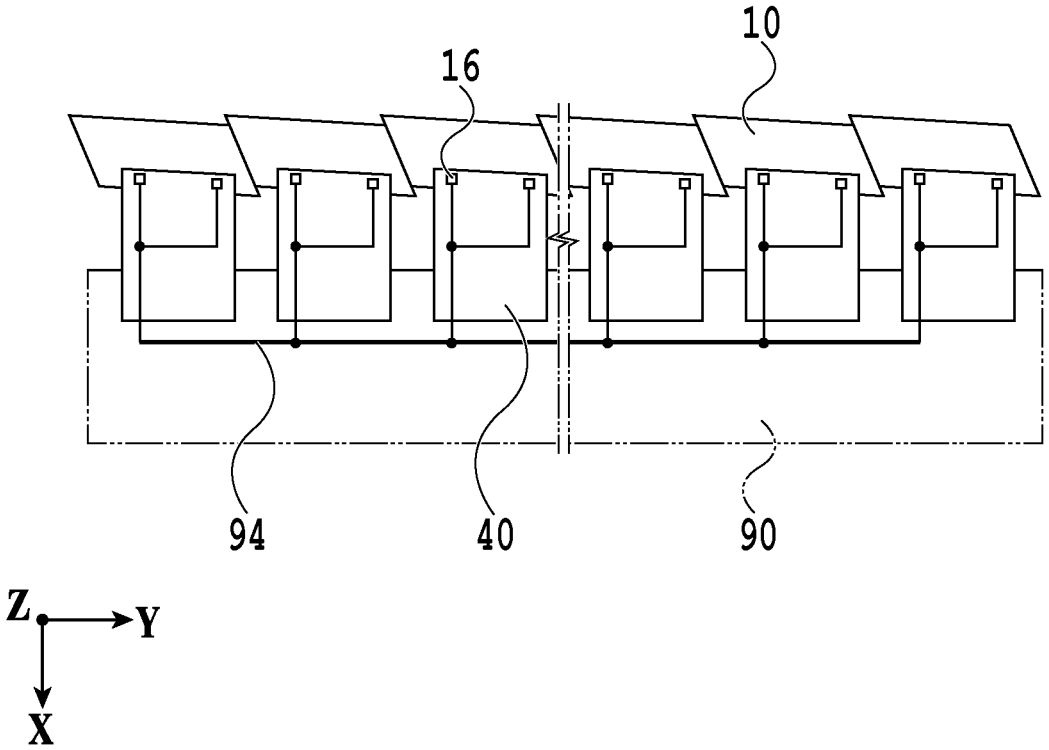

FIG. 1B is a schematic diagram showing a connection of the electrically conductive protection layer of the element substrate with the electrical wiring substrate of the liquid ejection head in the first embodiment of the present invention shown in FIG. 1A. The external connecting terminal 16 of each element substrate 10 is connected to the electrical wiring substrate 90 of the liquid ejection head 3 via the flexible wiring substrate 40. The electrically conductive protection layer 106 of each element substrate is connected to one common wiring 94 provided on the electrical wiring substrate 90 via the two external connecting terminals (connecting terminals for electrically conductive protection layer) 16 for connecting the electrically conductive protection layer to the outside. The wiring in charge of the connection extends from the two external connecting terminals 16, respectively, and bundled (connected) into one wiring on the flexible wiring substrate 40, and then connected to the common wiring 94 as one wiring. The electrically conductive protection layers 106 of the plurality of element substrates 10 are connected to one another via the common wiring 94 of the electrical wiring substrate 90. Because of this, the electrical capacity of each electrically conductive protection layer is substantially a total of the electrical capacities of the plurality of electrically conductive protection layers connected to one another and is large compared to the electrical capacity of the single electrically conductive protection layer. Consequently, according to the present embodiment, it is possible to effectively disperse and attenuate an ESD current that flows in from the ejection port or the like and reaches the electrically conductive protection layer 106 in the printing operation and the like of the liquid ejection head, and therefore, it is made possible to suppress the breakdown of the insulating layer by the ESD.

Further, as described above, in the present embodiment, the wirings in charge of the connection between the two external connecting terminals 16 and the common wiring 94 are bundled (connected) into one wiring on the flexible wiring substrate 40, that is, the wiring that is connected with the common wiring declines in number due to concentration. According to this configuration, the number of electrical connecting portions necessary at the time of incorporating the ejection module in which the element substrate 10 is incorporated in the liquid ejection head may be small. That is, by connecting the electrically conductive protection layer 106 with the plurality of external connecting terminals 16, it is possible to reduce the number of electrical connecting portions between the terminal 42 of the flexible wiring substrate 40 and the connecting terminal 93 of the electrical wiring substrate 90 while making it easy for the ESD current to escape to the outside from the element substrate 10.

Further, the present embodiment is excellent from the viewpoint of the inspection of the insulation properties between the above-described electrically conductive protection layer, and the heating element and the electrical wiring. In the case of the configuration in which the electrically conductive protection layer 106 is set to the ground potential within the element substrate in order to protect the insulating layer from the ESD current, it is difficult to make the inspection of the insulation properties of the element substrate. In the present embodiment, it is possible to make the inspection of insulation properties before incorporating the element substrate in the liquid ejection head. Further, in the subsequent state where the element substrate has been incorporated in the liquid ejection head, by the electrically conductive protection layers 106 of the plurality of element substrates 10 being connected to one another via the common wiring 94 of the electrical wiring substrate 90, it is made possible to suppress the breakdown of the insulating layer by the ESD.

Second Embodiment

Figure 2A:
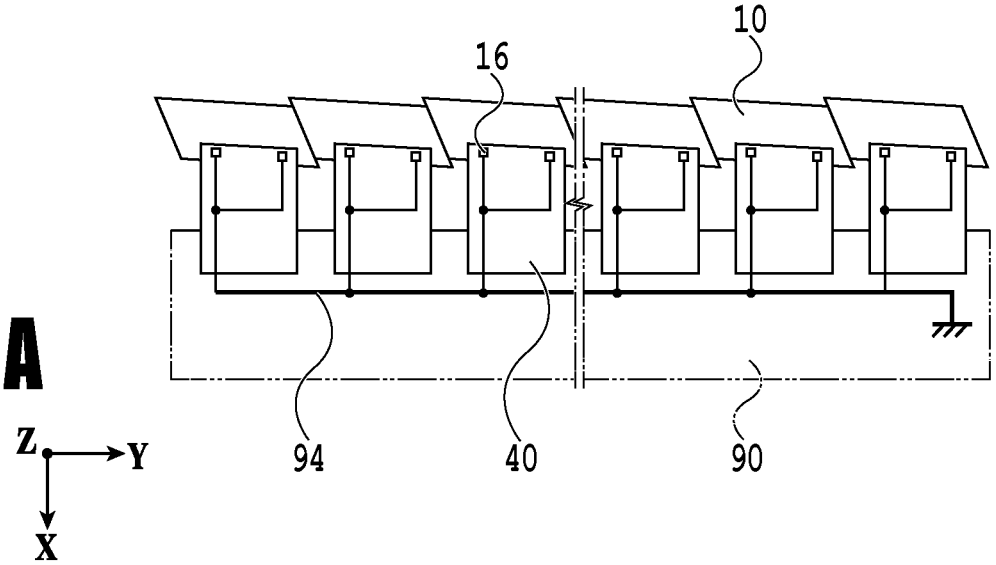
FIG. 2A is a wiring connection diagram on an element substrate of a second embodiment of the present invention.
Figure 2B:
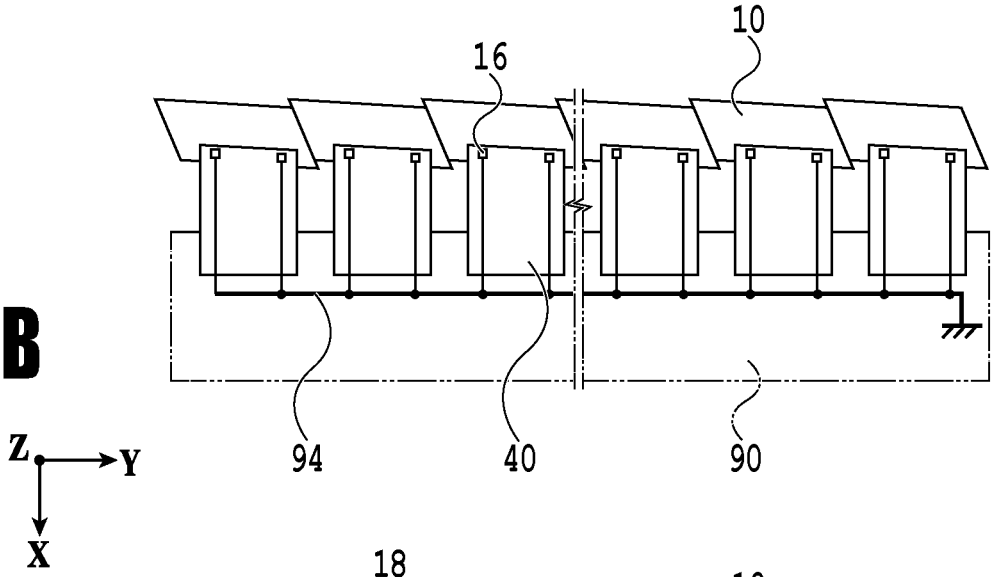
FIG. 2B is an explanatory diagram of a modification example of the wiring in FIG. 2A.

By using FIG. 2A and FIG. 2B, a second embodiment according to the liquid ejection head of the present invention is explained. Detailed explanation of the same configurations as those of the first embodiment is omitted.

FIG. 2A is a schematic diagram showing a connection of the electrically conductive protection layer of the element substrate with the electrical wiring substrate of the liquid ejection head as in FIG. 1B. The electrically conductive protection layer 106 is connected to the two external connecting terminals 16 on each element substrate and the wirings extending from those electrically conductive protection layers 106 are bundled (connected) into one wiring on the flexible wiring substrate 40, and then connected with the common wiring 94 on the electrical wiring substrate 90 and this is the same as in the first embodiment. Further in the second embodiment, the potential of the common wiring 94 of the electrical wiring substrate 90 is set to the ground potential. The present embodiment further brings about the effect that it is possible to secure an effective outflow path of an ESD current that flows into each electrically conductive protection layer by the electrically conductive protection layers 106 of the plurality of element substrates being connected to the one common wiring 94 and the potential of the common wiring 94 being set to the ground potential.

FIG. 2B shows a modification example of the configuration in FIG. 2A. In FIG. 2B, the electrically conductive protection layer 106 on each element substrate is connected to the two external connecting terminals 16 and this is the same as in the configuration in FIG. 2A. In the present modification example, the wirings extending from the two external connecting terminals 16, respectively, are not connected on the flexible wiring substrate 40 but connected directly to the common wiring 94 of the electrical wiring substrate 90 via the flexible wiring substrate 40 as individual wirings. According to this configuration, the wiring layout within the flexible wiring substrate 40 becomes simple, and therefore, wiring routing whose stress on the wiring within the flexible wiring substrate 40 is reduced is enabled as well as the manufacturing is made easy. It is possible to preferably adopt this configuration in a case where, in particular, the interval between two external terminals is long or in a case where the flexible wiring substrate is short in length in the X-direction.

It is possible to appropriately adopt one of the configurations in FIG. 2A and FIG. 2B or a combination thereof within one liquid ejection head. That is, one liquid ejection head may include one of or both the connection configuration shown in FIG. 2A and the connection configuration shown in FIG. 2B. Further, in a case where the electrically conductive protection layer 106 is connected to the three or more external connecting terminals 16 on each element substrate, all or part of the wirings extending from the three or more external connecting terminals, respectively, may be connected to one another on the flexible wiring substrate 40, or not connected. In the present embodiment, the degree of freedom of the wire connection layout within the flexible wiring substrate 40 is high and it is possible to turn the wiring layout into a more effective one in accordance with the wire connection layout within the flexible wiring substrate 40.

Figure 2C:
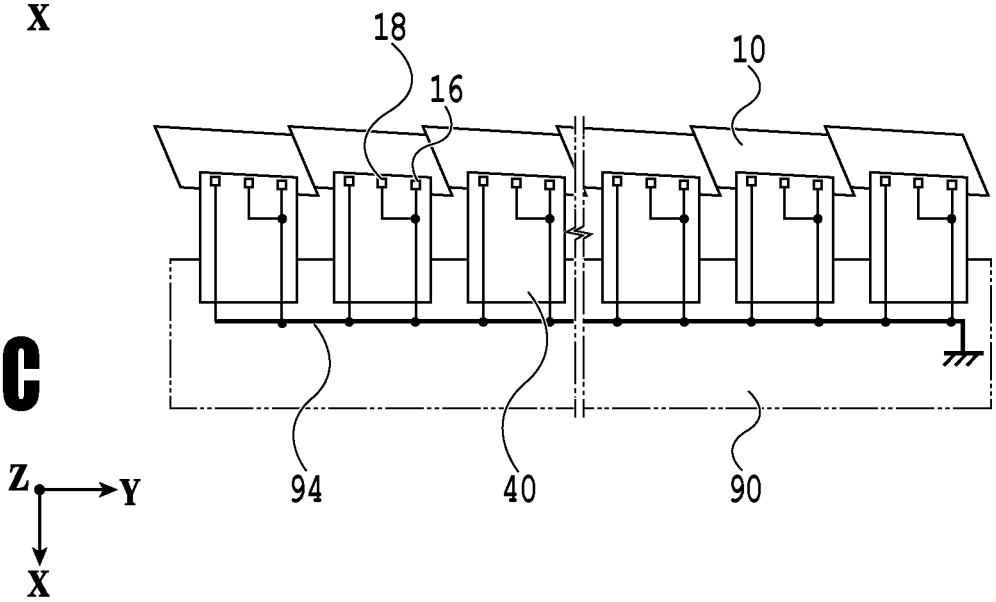
FIG. 2C is an explanatory diagram of a modification example of the wiring FIG. 2B.

FIG. 2C shows a modification example of the configuration in FIG. 2B. In the present modification example, each element substrate 10 further includes a ground terminal (VSS) 18 in the configuration shown in FIG. 2B. The ground terminal 18 is connected to the base material 113 of the element substrate 10 via the electrical wiring 103 and the connecting member 102 and set to the ground potential within the element substrate 10. The ground terminal (VSS) 18 of the element substrate 10 is not connected to any one of the electrically conductive protection layer 106 and the electrical wiring 103 on the element substrate 10. As shown in FIG. 2C, the ground terminal (VSS) 18 of the element substrate 10 is connected to the wiring on the flexible wiring substrate 40, which connects the external connecting terminal 16 and the common wiring 94. According to this configuration, in addition to being capable of causing an ESD current that flows into each electrically conductive protection layer to flow toward the common wiring 94 through the wiring on the flexible wiring substrate 40, it is possible to cause the ESD current to flow toward the base material 113 via the ground terminal (VSS) 18. That is, it is possible to secure a more effective outflow path of the ESD current that flows into each electrically conductive protection layer. Further, also in a case where the ESD current flows into the electrical wiring 103 or a circuit other than the electrically conductive protection layer 106, it is possible to secure an outflow path of the ESD current that flows toward the common wiring 94 through the wiring on the flexible wiring substrate 40. In FIG. 2C, only one of the wirings extending from the two external connecting terminals 16 on each element substrate is connected with the ground terminal (VSS) 18, but both the wirings may be connected therewith.

As described above, according to the second embodiment, it is possible to effectively disperse and attenuate an ESD current that flows in from the ejection port and the like in the printing operation and the like of the liquid ejection head. Therefore, it is made possible to suppress the breakdown of the insulating layer by the ESD and it is possible to improve the reliability of the print head.

Third Embodiment

Figure 3:
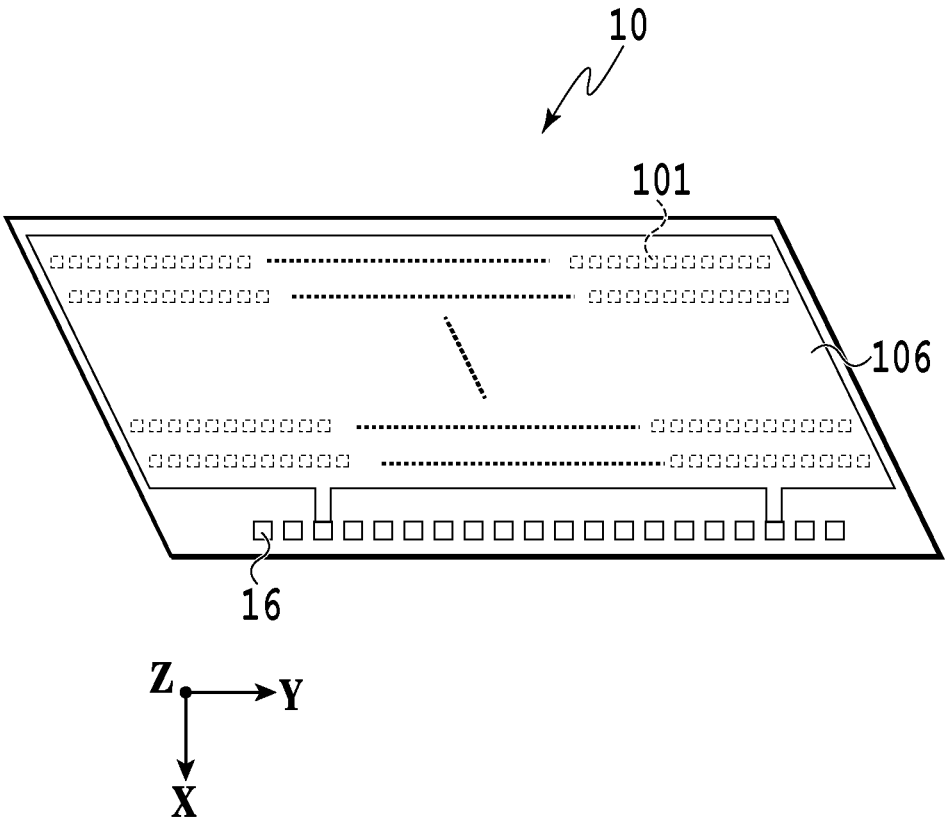
FIG. 3 is a plan diagram of an element substrate in a third embodiment of the present invention.

By using FIG. 3, a third embodiment according to the liquid ejection head of the present invention is explained. FIG. 3 is a plan schematic diagram of an element substrate. Detailed explanation of the same configurations as those of the first embodiment is omitted. In the present embodiment, the electrically conductive protection layer 106 covers all the arrays of the plurality of heating element arrays 101R and is connected to the plurality (two) of external connecting terminals 16. In other words, in the present embodiment, the electrically conductive protection layer 106 is provided as one having one belt-shaped portion covering all of the plurality of heating element arrays 101R on the element substrate 10. By increasing the area of the electrically conductive protection layer 106 on the element substrate 10, the electrical capacity of the electrically conductive protection layer 106 becomes large. The belt-shaped portion of the electrically conductive protection layer 106 may be substantially arranged approximately across the entire surface of the element substrate 10. According to the present embodiment, the dispersion effect of an ESD current that flows in from the surface of the element substrate becomes more significant.

Fourth Embodiment

Figure 4:
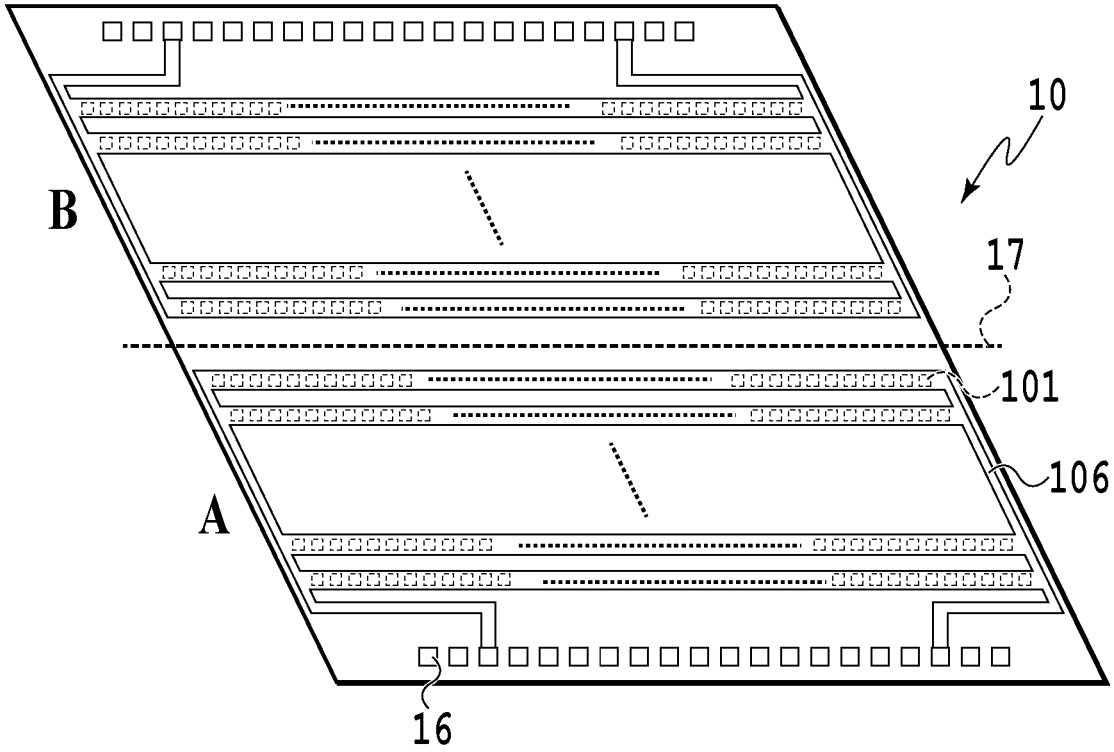
FIG. 4 is a plan diagram of an element substrate in a fourth embodiment of the present invention.

By using FIG. 4, a fourth embodiment according to the liquid ejection head of the present invention is explained. FIG. 4 is a plan schematic diagram of an element substrate. Detailed explanation of the same configurations as those of the first embodiment is omitted. The element substrate 10 of the present embodiment is an aspect in which the two element substrates (element substrates A and B), that is, the element substrate explained in the first embodiment and the same element substrate rotated by 180 degrees are coupled. The element substrates A and B may be provided on the same base material 113. On the element substrate 10 of the present embodiment, with a dividing line 17 shown in FIG. 4 as a boundary, the element substrate A and the element substrate B are not electrically connected to each other. As in the present embodiment, in a case where the external connecting terminal array in which the plurality of external connecting terminals 16 are arranged side by side is located on both end sides with the center portion of the substrate being sandwiched in between, by connecting the electrically conductive protection layer 106 to the nearest external connecting terminal 16 within the group divided by the dividing line 17, it is possible to reduce the length of the path. Due to this, according to the present embodiment, it is possible to cause an ESD current to escape quickly.

Other Embodiments

In the first to fourth embodiments described above, explanation is given on the assumption that the electrically conductive protection layer 106 of each element substrate 10 is connected to the two external connecting terminals 16, but the present invention is not limited to this. The electrically conductive protection layer 106 of each element substrate 10 may be connected to one or a plurality (three or more) of external connecting terminals 16. In a case where the number of connected external connecting terminals is large, it is possible to cause the ESD that flows in to escape quickly to the outside from the nearest external connecting terminal. In a case where the number of connected external connecting terminals is small, it is made possible to design a compact configuration.

In the above-described embodiments, explanation is given on the assumption that the electrically conductive protection layer 106 has one or a plurality of belt-shaped portions covering one array or all the arrays of the plurality of heating element arrays 101R, but the present invention is not limited to this. As long as the electrically conductive protection layer 106 functions as an electrically conductive protection layer and does not depart from the scope of the present invention, the shape of the electrically conductive protection layer 106 and the number of heating element arrays 101R covered by the electrically conductive protection layer 106 or the number of heating elements 101 are not limited. For example, for the one heating element array 101R, it may also be possible for the electrically conductive protection layer 106 to have a portion covering part of the plurality of heating elements 101 included in the heating element array 101R and a portion covering the rest of the portion.

In the above-described fourth embodiment, the element substrate A and the element substrate B grouped with the dividing line 17 as a boundary are rotationally symmetric with each other and have the same configuration. However, in the present embodiment, as long as it is possible to connect the electrically conductive protection layer to the nearest external connecting terminal, it is possible to obtain the effect of a reduction in the path through which the above-described current is caused to escape, and therefore, the grouping method that can be applied to the present invention is not limited to the present embodiment.

It is obvious for a person skilled in the art that the various configurations of the above-described embodiments can be combined appropriately without departing from the scope of the present invention.

According to the embodiments of the present invention explained above, in the liquid ejection head including the element substrate having the heating element that produces heat energy for liquid ejection by energization, it is possible to suppress the occurrence of dielectric breakdown of the insulating layer due to static electricity flowing into the element substrate. According to the embodiments of the present invention, it is not necessary to provide an ESD protection element, such as a grounded-gate MOS, on the element substrate in order to protect the insulating layer from the ESD. Because of this, the degree of freedom of the layout of the plurality of element substrates in the liquid ejection head becomes high without an increase in the size of the element substrate. Due to this, it is made possible to provide an inexpensive liquid ejection head having a compact configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-026778 filed Feb. 19, 2018, which is hereby incorporated by reference herein in its entirety.

What is claimed is:

1. A liquid ejection head comprising:

a plurality of element substrates including a first element substrate and a second element substrate, each of the first element substrate and the second element substrate having a heating element array in which a plurality of heating elements producing heat energy for liquid ejection by energization is arrayed, an electrically conductive protection layer covering the plurality of heating elements, an insulating layer arranged between the plurality of heating elements and the electrically conductive protection layer, and a connecting terminal for connecting to the outside;

a first flexible wiring substrate including a first wiring electrically connected with the conductive protection layer of the first element substrate via the connecting terminal of the first element substrate;

a second flexible wiring substrate including a second wiring electrically connected with the conductive protection layer of the second element substrate via the connecting terminal of the second element substrate; and an electrical wiring substrate including a common wiring electrically connected with the first wiring and the second wiring.

2. The liquid ejection head according to claim 1, wherein the electrically conductive protection layer includes a belt-shaped portion covering the heating element array and a connecting portion connecting the belt-shaped portion and the connecting terminal.

3. The liquid ejection head according to claim 2, wherein the connecting portion connects a plurality of different portions of the belt-shaped portion and a plurality of different connecting terminals corresponding to each of the plurality of different portions of the belt-shaped portion.

4. The liquid ejection head according to claim 3, wherein the plurality of different portions of the belt-shaped portion is located on one end side and on the other end side in an array direction of the heating element array.

5. The liquid ejection head according to claim 2, wherein at least one of the first element substrate and the second element substrate has a plurality of the heating element arrays, the plurality of the heating element arrays is covered by a plurality of the belt-shaped portions each covering at least one of the plurality of the heating element arrays, and the connecting portion connects the plurality of the belt-shaped portions to one another.

6. The liquid ejection head according to claim 2, wherein at least one of the first element substrate and the second element substrate has a plurality of the heating element arrays, and all of the plurality of the heating element arrays are covered by the belt-shaped portion covering the entire surface of the element substrate.

7. The liquid ejection head according to claim 1, wherein the first element substrate includes a plurality of connecting terminals, the first wiring is electrically connected with the conductive protection layer of the first element substrate via the plurality of connecting terminals of the first element substrate, and the first wiring includes a plurality of first portions on a side of the plurality of connecting terminals and at least one second portion on a side of the common wiring, and the first portions and the second portion are connected to each other on the first flexible wiring substrate so that a number of the second portions is less than a number of the first portions.

8. The liquid ejection head according to claim 1, wherein the first element substrate includes a plurality of connecting terminals, the first flexible wiring substrate includes a plurality of first wirings electrically connected with the conductive protection layer of the first element substrate via each of the plurality of connecting terminals of the first element substrate, and the plurality of the first wirings are connected with the common wiring at a plurality of portions corresponding to each of the plurality of the first wirings.

9. The liquid ejection head according to claim 1, wherein a potential of the common wiring is set to a ground potential.

10. The liquid ejection head according to claim 1, wherein the first element substrate further comprises a ground terminal set to a ground potential on the element substrate, and the ground terminal is connected to the first wiring.

11. The liquid ejection head according to claim 1, wherein the liquid ejection head is a line type in which the plurality of element substrates including the first element substrate and the second element substrate are arranged so as to be located side by side along a length corresponding to a width of a printing medium.

12. A manufacturing method of a liquid ejection head, wherein the liquid ejection head includes:

a plurality of element substrates including a first element substrate and a second element substrate, each of the first element substrate and the second element substrate having a heating element array in which a plurality of heating elements producing heat energy for liquid ejection by energization is arrayed, an electrically conductive protection layer covering the plurality of heating elements, an insulating layer arranged between the plurality of heating elements and the electrically conductive protection layer, and a connecting terminal for connecting to the outside; and an electrical wiring substrate electrically connected to the first element substrate and the second element substrate via the connecting terminal, the manufacturing method of the liquid ejection head comprising:

a step of providing a base material on which the heating element electrically connected with an electrical wiring, the insulating layer, the electrically conductive protection layer, and the connecting terminal are formed;

a step of making an electrical inspection of the electrically conductive protection layer; and a step of manufacturing the first element substrate and the second element substrate each including the base material after the electrical inspection is made and electrically connecting the electrically conductive protection layer of each of the first element substrate and the second element substrate to a common wiring provided on the electrical wiring substrate via the connecting terminal, wherein the electrical inspection detects a leak current at the time of applying a negative potential to the electrically conductive protection layer in a state where the potential of the electrical wiring is set to a ground potential.

13. The manufacturing method of the liquid ejection head according to claim 12, wherein the electrical wiring includes a protection circuit against static electricity.

* * * * *